US005899028A

United States Patent [19]

Warner

[11] Patent Number: 5,899,028

[45] Date of Patent: May 4, 1999

[54] SADDLE SPAN SHELTER AND JOINING SYSTEM

[76] Inventor: Gery Warner, 15427 66th Avenue, Surrey, British Columbia, Canada, V3S 2A1

[21] Appl. No.: 08/677,883

[22] Filed: Jul. 10, 1996

[30] Foreign Application Priority Data

Aug. 11, 1995 [KR] Rep. of Korea ..... 95-25057

[51] Int. Cl.[6] ..... E04B 1/32

[52] U.S. Cl. ..... 52/80.2; 52/63; 52/86

[58] Field of Search ..... 52/80.1, 80.2, 52/81.2, 86, 66, DIG. 10, 63; 135/124, 125, 126, 127, 128, 130, 131, 133, 135

[56] References Cited

U.S. PATENT DOCUMENTS

| | | | |
|---|---|---|---|
| 3,215,153 | 11/1965 | Huddle | 52/80.2 |
| 3,388,711 | 6/1968 | Huddle | 52/80.2 X |
| 3,626,647 | 12/1971 | Guzelimian | 52/80.2 |
| 3,886,961 | 6/1975 | Greiger et al. | 52/80.1 X |
| 3,990,194 | 11/1976 | Huddle | 52/81.2 |
| 4,036,244 | 7/1977 | Huddle | 52/86 X |
| 4,064,663 | 12/1977 | Moss | 52/86 X |
| 4,106,520 | 8/1978 | Warner et al. | 135/133 |
| 4,163,295 | 8/1979 | Schutz | 135/135 X |
| 4,676,032 | 6/1987 | Jutras | 52/86 X |
| 4,794,742 | 1/1989 | Henderson | 52/80.2 |

FOREIGN PATENT DOCUMENTS

| | | | |
|---|---|---|---|
| 33606 | 11/1964 | German Dem. Rep. | 52/80.2 |
| 3-122378 | 5/1991 | Japan | 52/80.1 |
| 1390327 | 4/1988 | U.S.S.R. | 52/80.1 |

*Primary Examiner*—Michael Safavi
*Attorney, Agent, or Firm*—Anderson, Levine & Lintel, LLP

[57] ABSTRACT

Two curved arch rib supports are provided with a pre-shaped flexible membrane cover attached to the ribs; the ends of the ribs are hinged on a common locus at base supports. When erected, a saddle shaped roof is formed to which contoured end walls may be added. Additional modules may be joined to the structure so formed, by applying a pre-shaped and independent fabric membrane or cable net attached by rings to only each of the two structure base pivot axles. A catenary cable and web belt stress concentrator connect each ring to its opposite on each separate structure. The cable and web are of pre-set length and are shorter than the perimeter of the outer chord of the beam. Alternatively, for joining a plurality of the saddle shaped structures, geodetic stress concentrators may be added to enhance and maintain the shape and performance of the cable net, thus stabilizing and drawing pre-stress or wind reactions from the membrane and facilitating their efficient flow to the ground anchors in purely tensile forces.

26 Claims, 8 Drawing Sheets

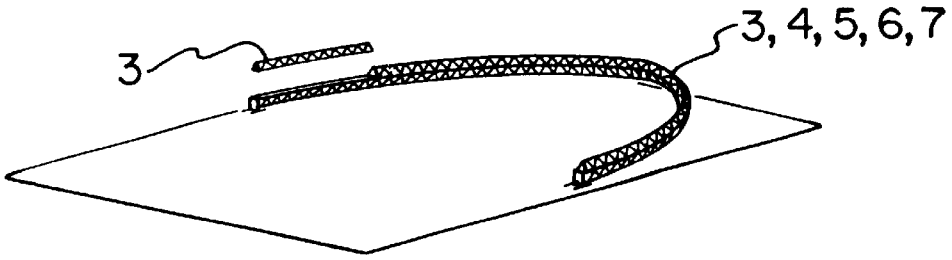
FIG. 1
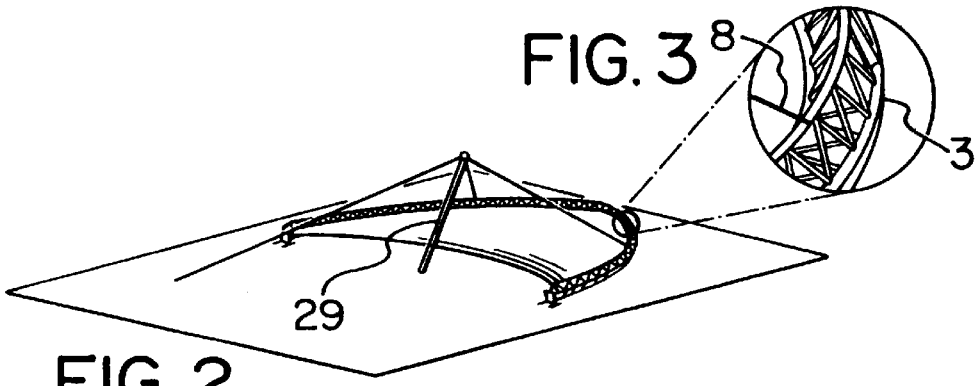
FIG. 3
FIG. 2
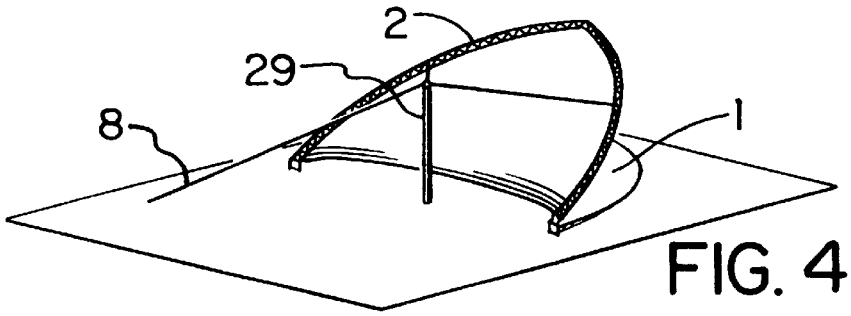
FIG. 4
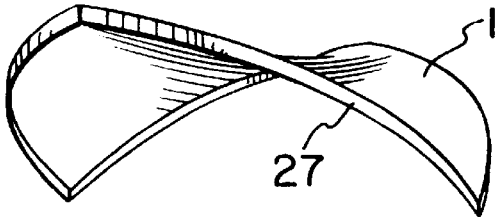
FIG. 5
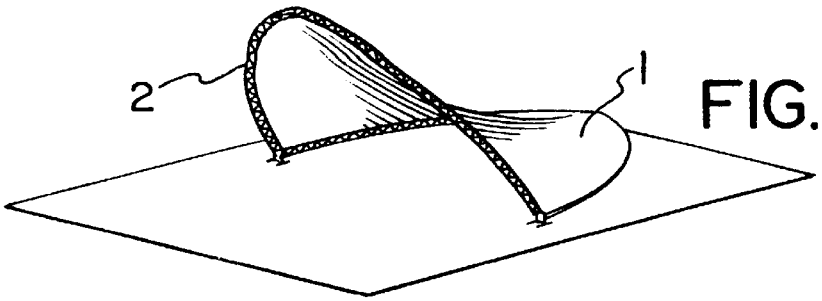
FIG. 5a

SADDLE SPAN SHELTER AND JOINING SYSTEM

BACKGROUND OF THE INVENTION

This invention relates to new and useful improvements in relocatable shelters, particularly tents for special events as stage covers and assembly halls which utilize a multiple arched rib support type configuration having a cover secured thereto and which can be erected and removed readily and easily, as well as expanded in a plurality of configurations suitable for outdoor special events.

Stage covers and the like are of two varieties. One typical stage cover is a pole and fabric tensile type cover consisting of posts holding pre-shaped fabric out to provide a roof and sides with clearances for performers and equipment below, and open on one side for visibility to the crowd. Fabric is held stable against weather by virtue of its pre-tensioned anticlastic shape. A second known stage cover consists of fabric attached to parallel interspaced beams. Fabric is held stable by virtue of the strength and number of beams.

The disadvantages of the pole-type cover include difficulty of installation because of the required accuracy of anchor placement as well as erection procedures. In addition, the pole type structure cannot be readily expanded or changed for alternate uses. Sight lines are less than optimal because of the requirement for poles to hold up the fabric roof. The poles also interfere with the audience's visibility.

The disadvantages of the parallel beam type cover include high cost because of the number of beams required, the expense of the beams both in capital and cost of installation, the cost of erection procedure requiring use of a crane to place the beams, and the cost of installing the individualized fabric panels.

SUMMARY OF THE INVENTION

The present invention overcomes these disadvantages by providing a shelter consisting of two curved arch rib supports each hinged at their base on a common locus so that they can be assembled on the ground complete with roof and end wall membrane, and simply pulled into erected position by a vehicle or man-power using a gin-pole and rope. A flexible cover is secured to the individual rib supports so that by rotating one rib support, the entire Saddle Span fabric structure can be erected and thereby provides a stable enclosure or shelter not requiring any internal supports apart from the plurality of rib supports hereinbefore mentioned. The beams cantilever out in both opposing directions beyond the common hinge and at 90 degrees to that common locus.

Furthermore, these structures so formed, may be installed in various locations close to one another and be joined to form larger structurally interlocked fabric enclosures for other uses besides stage covers.

Furthermore, the mechanism for interlocking the so-formed fabric structures may be readily and easily manufactured and installed creating a positive structural connection utilizing the inherent strength of materials in the fabric with its efficiency of weight and attendant low cost.

Furthermore, the mechanism for interlocking the so-formed fabric structures may be readily and easily installed creating a positive structural connection which self equilibrates the pretensile and wind forces back into the frame, creating greater structural and thereby, installation efficiencies and further minimizing the number of anchorage locations required.

PURPOSE

The principle object and essence of the invention is therefore to provide a device of the character herewithin described in which the arched rib supports together with the cover cannot only be collapsed one upon the other for ease of installation and removal safely from ground level, but that once erected, said arch supports may be utilized to support fabric roof linkages to provide larger expandable space.

Yet another object of the invention is to provide a device of the character herein described in which a multiplicity of Saddle Span fabric structures may be interconnected by fabric thus making a relatively large shelter if desired.

A still further object of the invention is to provide a device of the character herewithin described which is simple in construction, economical to manufacture and otherwise well suited to the purpose for which it is designated.

FIGURES

With the foregoing objects in view, and other such objects and advantages as will become apparent to those skilled in the art to which this invention relates as this specification proceeds, my invention consists essentially in the arrangement and construction of parts all as hereinafter more particularly described, reference being had to the accompanying drawings in which:

FIG. 1 is an isometric schematic view of one of the Saddle Span fabric structures in the assembly process;

FIG. 2 is an isometric schematic view of one embodiment of the invention in the assembly process showing fabric cover attached & gin pole rigged;

FIG. 3 shows attachment of cable to a beam of an arched rib of the embodiment in FIG. 2 during the erection process;

FIG. 4 is an isometric view showing the Saddle Span fabric structure during erection;

FIG. 5 is an isometric view showing a Saddle Span fabric structure fully erected without an end panel, with a valence (27) covering the arched beam;

Figure 6:
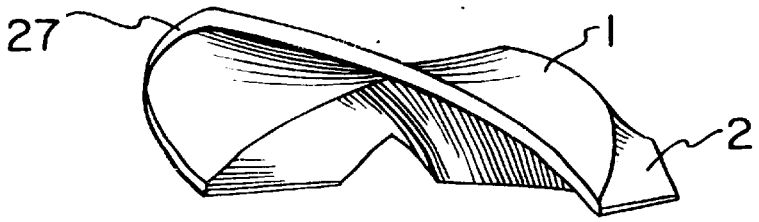
Figure 7:
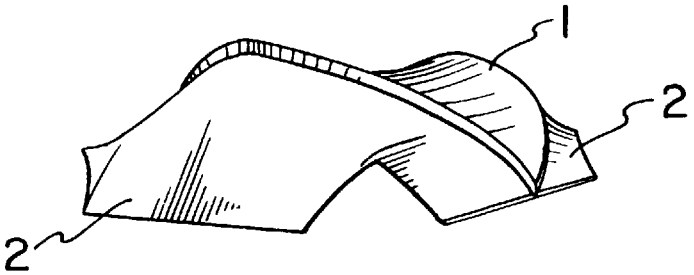
Figure 8:
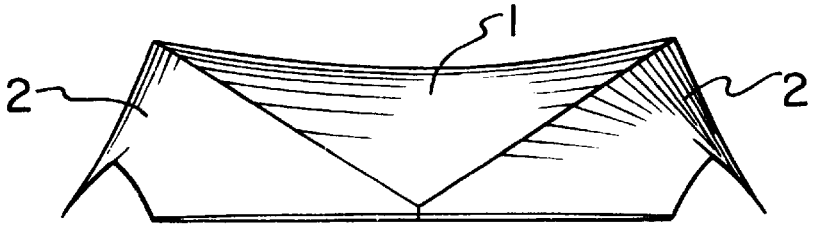
Figure 9:
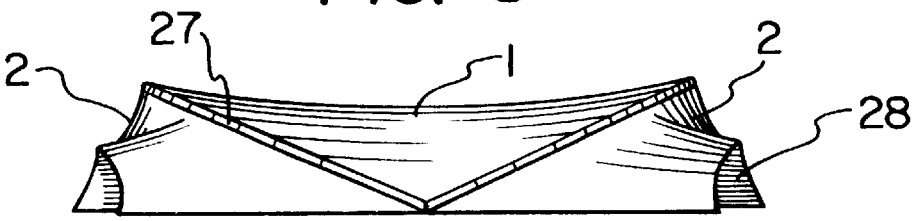
Figure 10:
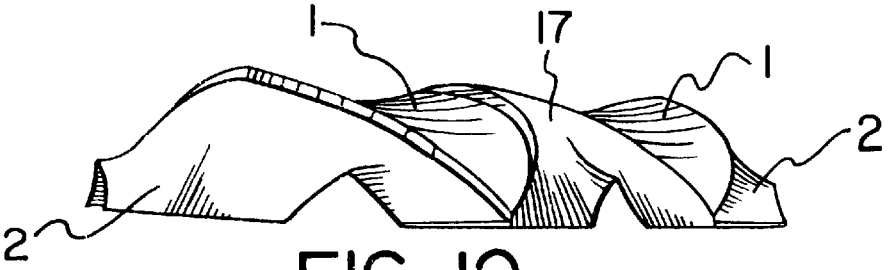
Figure 10A:
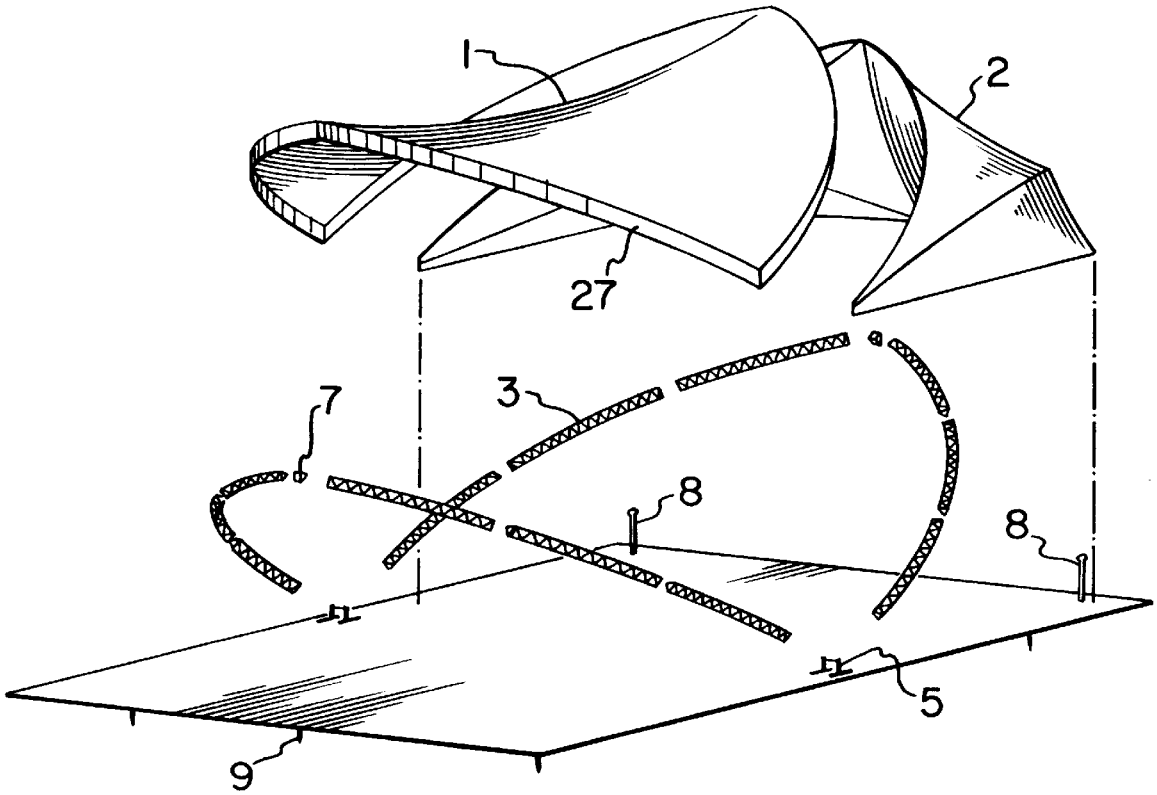
Figure 10B:
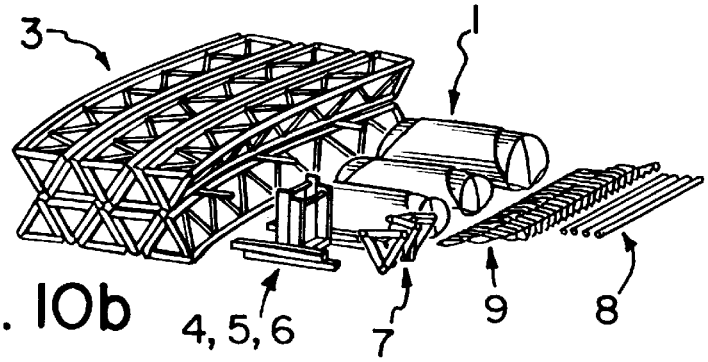

FIG. 5*a* is an isometric view showing a Saddle Span fabric structure, canted back at an angle for better audience viewing, an arched rib exposed from the valence;

FIG. 6 is an isometric view showing a Saddle Span fabric structure fully erected with one end panel as stage cover;

FIG. 7 is an isometric view showing a Saddle span fabric structure fully erected with both end panels;

FIG. 8 is a side elevation view showing a Saddle Span fabric structure fully erected with both end panels;

FIG. 9 is a side elevation view showing a different embodiment fully erected with both end panels, but with door zippers closed;

FIG. 10 is an isometric view showing two Saddle Span fabric structures fully erected with two end panels & joiner interlocking system in place;

FIG 10*a* is an isometric exploded view of the Saddle Span structure, stage cover embodiment;

FIG 10*b* is an isometric view of the structure ready for transport;

BASE ARRANGEMENT

Figure 11A:
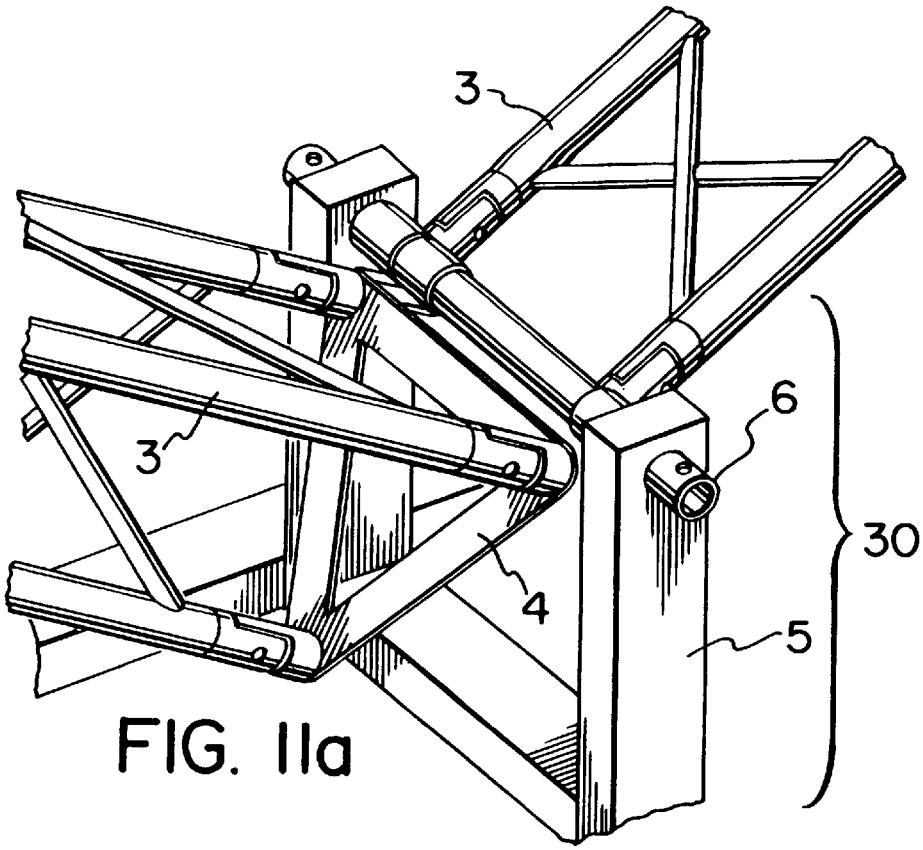
Figure 11:
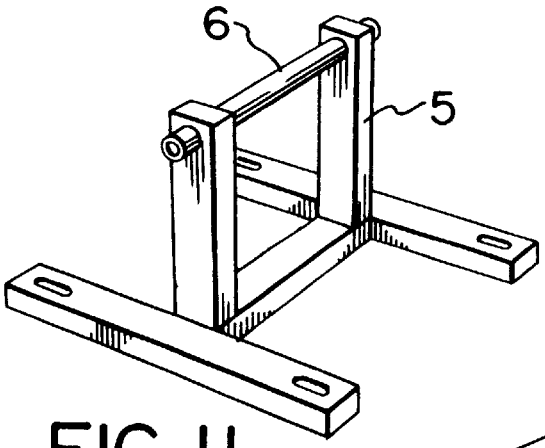
Figure 12:
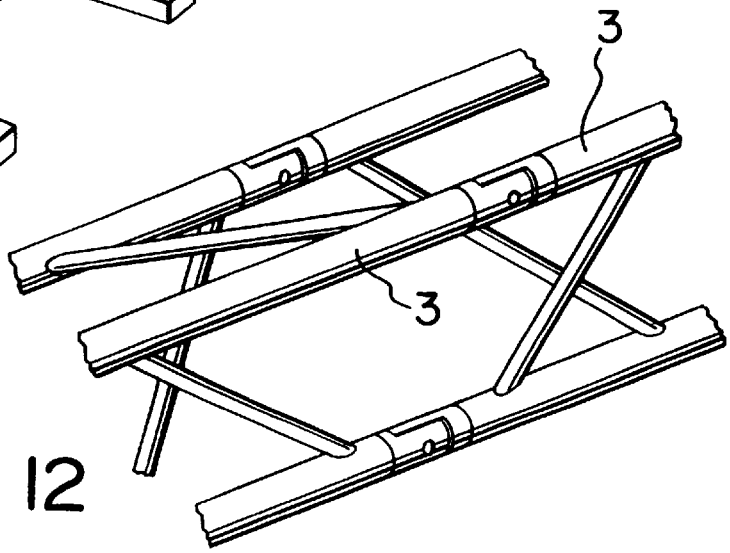
Figure 13:
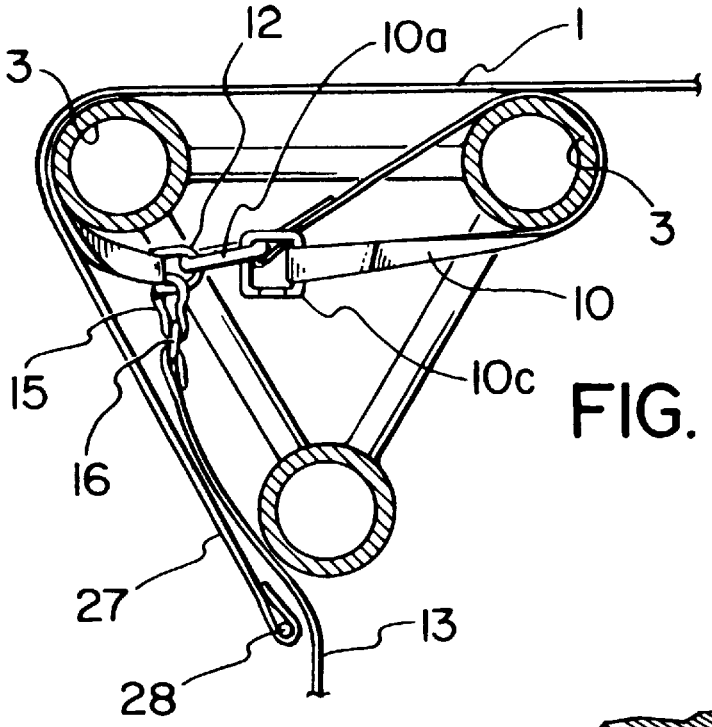
Figure 13A:
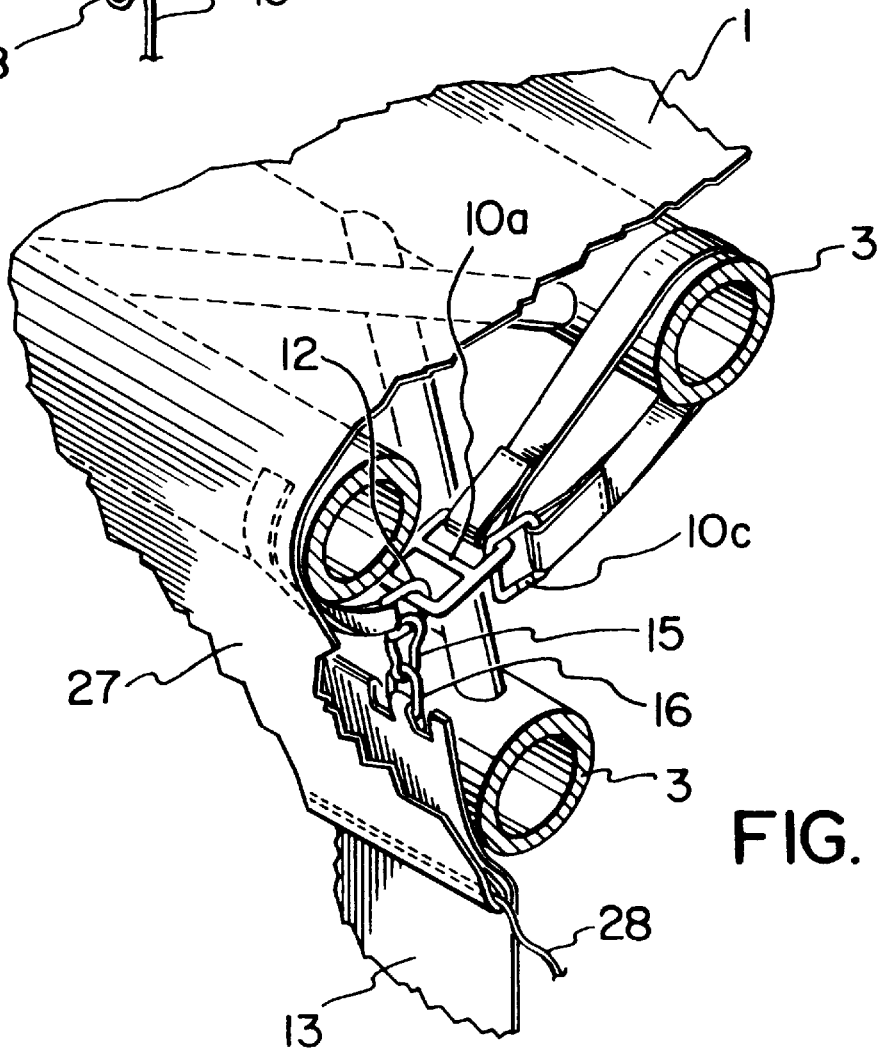
Figure 13B:
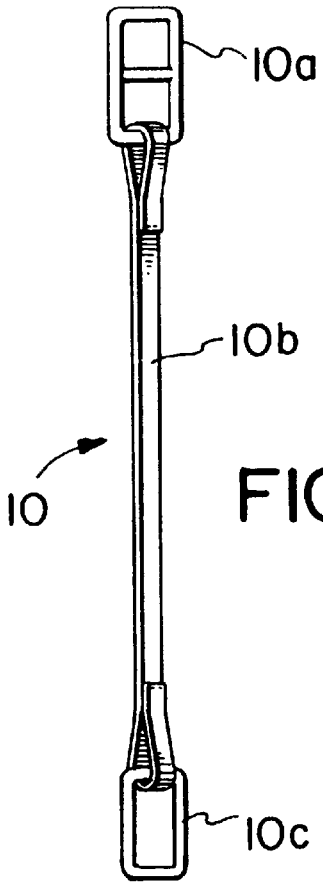
Figure 13C:
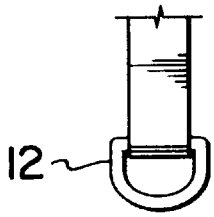

FIG. 11 is an isometric view of one embodiment of the base pivot with base pivot hinge & beam assemblies in place;

FIG. 11*a* is an isometric view of one embodiment of the base pivot;

FIG. 12 is an isometric view of one embodiment of the beam connection;

FIG. 13 is a sectional view of one embodiment of the fabric to beam connection;

FIG. 13*a* is a sectional view of one embodiment of the fabric installation device and procedure;

FIG. 13*b* is a side view of the strap, caribeener and ring illustrated in use in FIG. 13;

FIG. 13*c* is a side view of the dee ring shown in FIG. 13;

JOINER

Figure 15:
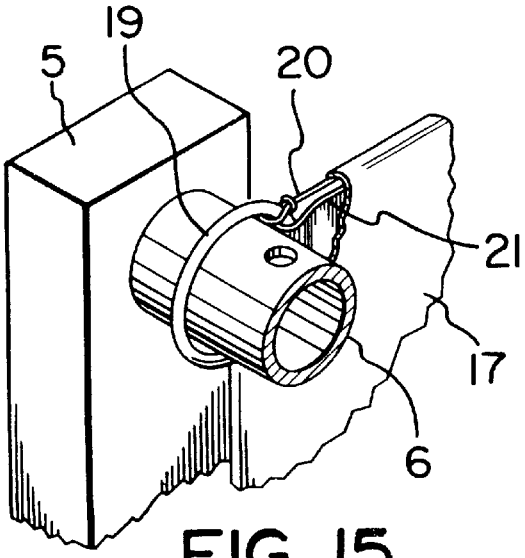
Figure 14:
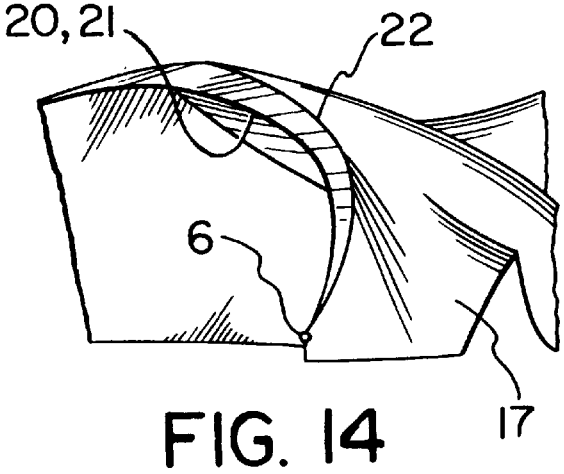
Figure 16:
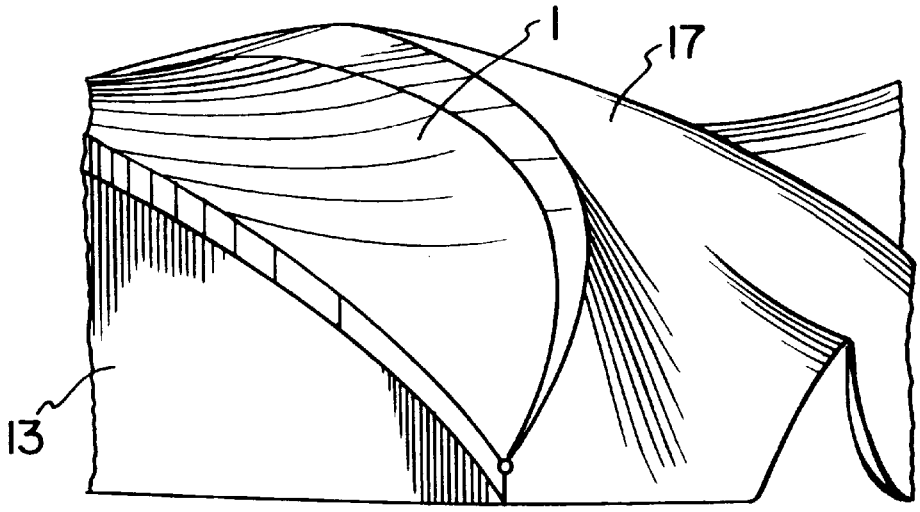

FIG. 14 is an isometric partial view of the fabric joiner system showing catenary cable shape in relation to beam edge;

FIG. 15 is an isometric partial view of the fabric joiner system installed joining several structures showing detail at the base attachment;

FIG. 16 is an isometric view of the fabric joiner system from the apex to base pivot axle, showing seam lines and indicating shape of joiner;

QUADRA JOINER

Figure 17:
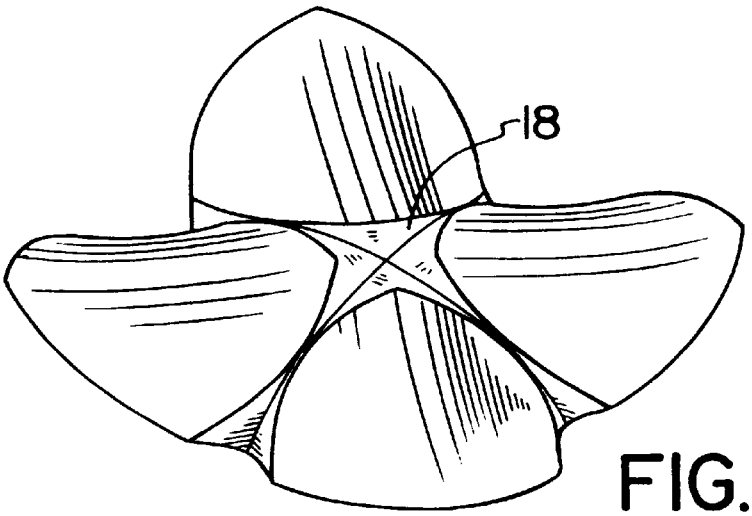
Figure 18:
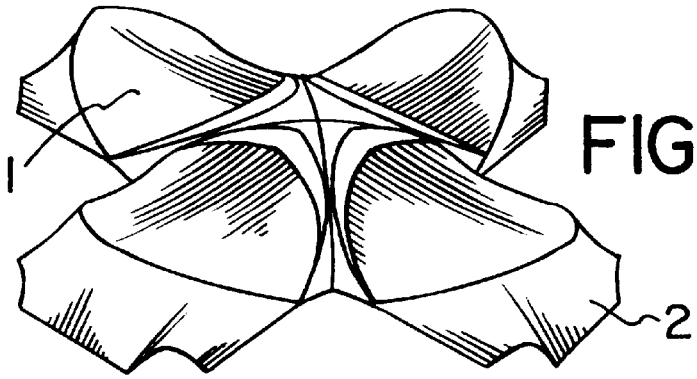
Figure 19:
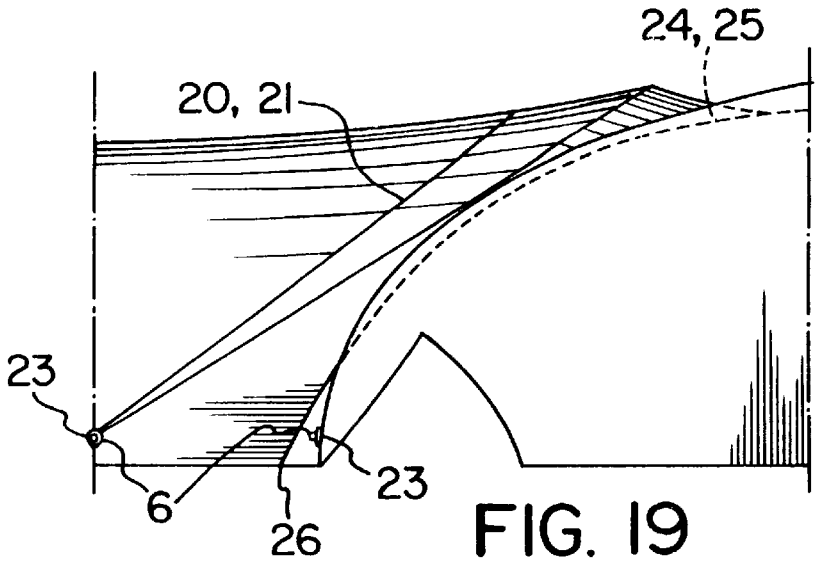
Figure 19A:
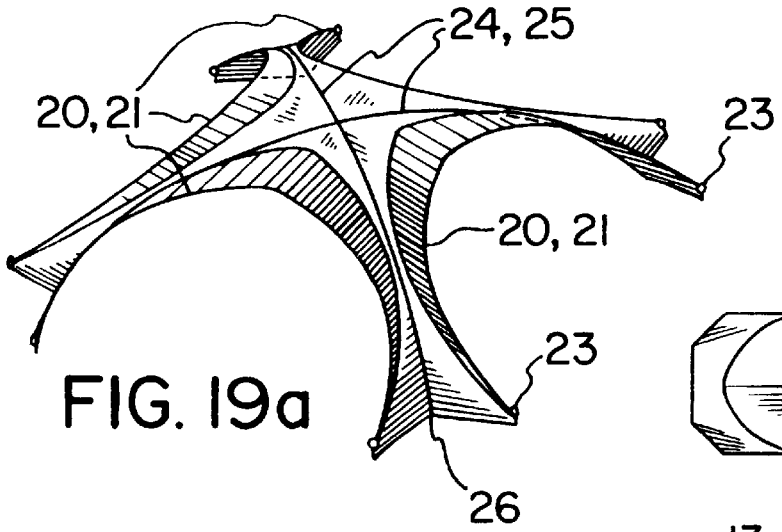
Figure 20:
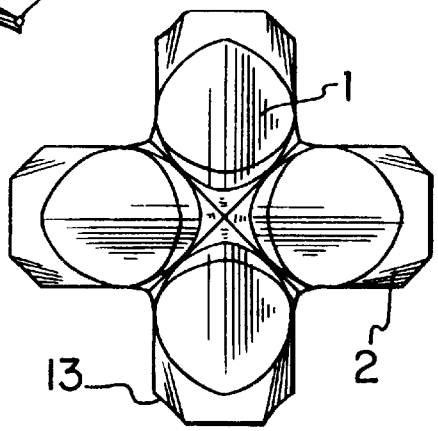
Figure 21:
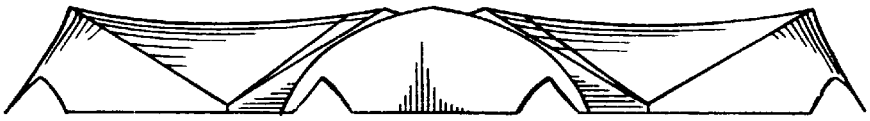
Figure 22:
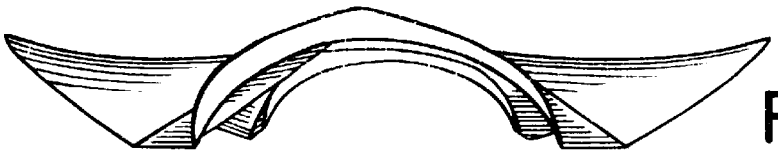

FIG. 17 is an isometric view of a finite element model showing four Saddle Span fabric structures fully erected with no end panels;

FIG. 18 is an isometric view showing four Saddle Span fabric structures fully erected with end panels;

FIG. 19 is a side elevation quarter view of one embodiment of the joiner fabric, geodetic and catenary cables, pre-tension and anchorage arrangement for a four Saddle Span fabric structure array;

FIG. 19*a* is an isometric view of one embodiment of the of the joiner fabric, geodetic and catenary cables, pre-tension and anchorage arrangement for a four Saddle Span fabric structure array;

FIG. 20 is a plan view of a set of four Saddle Span fabric structures erected and interlocked with fabric joiner system;

FIG. 21 is a side elevation view of four Saddle Span fabric structures interlocked with fabric joiner system;

FIG. 22 is a side elevation perspective view of a finite element model of four Saddle Span fabric structures interlocked with fabric joiner system.

In the drawings, like characters of reference indicate corresponding parts in the different figures.

DETAILED DESCRIPTION

Referring to FIGS. 1 and 4, a preferred embodiment of, the saddle span shelter consists of a frame 3,4,5,6,7 and a preshaped flexible membrane 1. The devices can be in any orientation in space with frame 3, 4, 5, 6, 7 and preshaped flexible membrane 1 only as shown in FIG. 5, or with one end wall as shown in FIG. 6 and 10A, or with two end walls as shown in FIGS. 7, 8, & 9. The shelter may have a valence 27, covering an arched rib support as in FIG. 5 or the valence 27 may be absent as in FIG. 5*a*. The shelter has openings in the end walls 2 (FIGS. 6,7,8,9,10) which may be left without a fabric covering or they may have a fabric covering 28 that serves as a door. This fabric 28 covering may be closed by a zipper (FIG. 9) thereby providing a degree of privacy.

The frame 3, 4, 5, 6, 7 is formed from a curved structurally rigid member such as a steel, aluminum, or composite truss 7, and may be sectionalized as shown in FIG. 10*a*. The truss 7 consists of three chords, namely, an outer and an inner chord and a third chord as shown in FIG. 3 and FIG. 10*b*. The degree of rigidity and resilience is controlled by the size of the truss 7 relative to the span of the frame.

The frame thus formed is made up of two individual arched members 3, and these members are held at a pivot hinge assembly 30 and shown in detail in FIG. 10*a*, 11 & 11*a*.

In FIG. 11 and FIG. 11*a* this pivot hinge assembly 30 takes the form of a hinge 4 and a pivot axle 6, held in clearance from the ground by a base of welded rectangular metal tubing 5. The pivot hinge assembly 30 of the preferred embodiment is situated such that the pivot axle 6 on opposite sides of the structure are lined up on a common axis, providing rotational freedom as clearly shown in FIG. 11*a*.

FIG. 10*b* shows the different components of the structure-trusses 7 to construct the two arched rib supports 3, preshaped flexible membrane 1, pivot hinge assembly 30, ground anchors 9 and cables 8. The erection of a saddle span structure using these components is shown in FIGS. 1–5. The two arched rib supports 3 are assembled and laid on top of each other on the ground as shown in FIG. 1. In FIG. 2, the preshaped flexible membrane 1 has been attached to the arched rib support 3. Cables 8 have been strung from the arched rib support 3 to the gin pole 29 and from the gin pole 29 to the ground. The gin pole 29 is rigged so that the arched rib supports 3 are hoisted off the ground. FIG. 3 shows the attachment of the cables 8 to the outer chord of the arched rib support 3. In FIG. 4, the structure has been elevated with the aid of the gin pole 29. The cable 8 is secured to the ground with an anchor 9. FIG. 5 and FIG. 5*a* show the erection of the saddle shaped structure in its final phase.

The frame 3,4,5,6,7 is covered by a preshaped flexible membrane 1 which may take the form of a cable net, a cable net with rigid covering plates, fabric or the like depending upon the application. In any event, means are provided to secure the preshaped flexible membrane 1 to the frame which, in this embodiment, take the form of a plurality of metal dee rings 12 (FIG. 13*c*), attached to the inner surface of the preshaped flexible membrane 1. Referring to FIG. 13*b*, web loops 10, that serve as straps, consist of an alpinist's caribeener 10*a* sewn to a web belt loop 10*b*, with a metal ring 10*c* locked in the web belt. The web loops 10 are attached on to the membrane dee ring 12, and, passing over the outer chord of the truss then around the inner chord (or alternatively the bottom chord), and back to the caribeener 10*a*, where the ring 10*c*, is snapped on to the caribeener, locking the membrane 1 to the frame truss 3 at intervals dictated by balancing strength of materials, environmental loads, and manufacturing economy. In an alternate embodiment, the web loop can be passed over only the outer chord. In another embodiment, the web loop can be passed over only the inner chord. In yet another embodiment, the web loop can be passed over only the bottom chord. In another embodiment, the web loop can be passed over all three chords.

Referring to FIG. 13, the preshaped flexible membrane 1 may be tensioned around the outer chord by means of a bar applied to the chord as fulcrum, forcing the ring 14 that attaches the metal dee 12 to the preshaped flexible membrane 1, around the chord closer to the inner chord, facilitating the attachment of the web loop 10 and at the same time adding an element of required pre-tension to the preshaped flexible membrane 1.

Referring to FIG. 13, walls 13, may be fastened to the structure by a secondary dee ring 14, caribeener 15, and dee ring 16, attached permanently to the wall membrane 13, which is part of the wall assembly 2. Referring to FIG. 13 and FIG. 13*a*, a valence 27 may be secured around the perimeter of the frame outer chord and secured with a drawstring or cable 28 to the pivot hinge assembly 30 by slipping the end loop of the cable onto the pivot axle 6.

The individual structures may be linked one to the other in various arrays as illustrated in FIGS. 10, 16, 17, 18, 20, 21, and 22. Different saddle span structures are linked together with a cable/membrane net hereby referred to as preshaped joiner membrane 17 which may take the form of 17 in FIG. 10, or 18 in FIG. 17.

The preshaped joiner membrane 17 has an inelastic catenary cable 20 and web belt stress connector 21 in a sleeve at the edges of the membrane. The catenary cable 20 and web 21 are of pre-set length and are shorter than the perimeter 22, of the beam's outer chord from one pivot hinge assembly 30 to an opposite pivot hinge assembly 30 on the same saddle span structure, as shown in FIG. 14. The catenary cable 20 and web 21 also terminate in loops 19 at either end that may be slipped over the pivot axle 6 of the adjoining saddle-shaped structure as shown in FIG. 15. This linkage system allows for greater structural efficiencies and thereby installation efficiencies and further minimizes the number of anchorage locations required.

Examples of saddle-span structures in linear array are shown in FIGS. 10 and 16.

Examples of saddle-span structures linked in radial array are shown in FIGS. 17,18,20,21, & 22, and in FIG. 19*a* linked in an eccentric radial array by means of a preshaped joiner membrane.

As shown in FIG. 19*a*, geodetic cables consisting of cable 24, in pocket and web belt 25, sewn to the inside of the pocket on the preshaped joiner membrane 18 may be added to enhance and maintain the shape and performance of this preshaped joiner membrane, thus stabilizing and drawing pre-stress or wind reactions from the membrane and facilitating their flow to the ground anchors 9, placed in the ground at location 26, in efficient purely tensile forces.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What we claim as our invention is:

1. A collapsible shelter comprising:

(a) first and second arched rib supports each having distal ends, the distal ends of the first arched rib support hingedly coupled to the corresponding distal ends of the second arched rib support;

(b) a pre-shaped flexible membrane secured to said first and second arched rib supports and having sufficient area so that when said first and second arched rib supports are rotated to a substantially upwardly position a saddle-shaped structure is formed; and (c) a pre-shaped joiner membrane operative to connect said collapsible shelter to at least one other substantially identical collapsible shelter in a substantially interconnecting position; and wherein each of said first and second arched rib supports is a truss structure having at least three spaced apart substantially parallel arched chords including an outer chord and an inner chord.

2. The shelter according to claim 1, wherein the preshaped flexible membrane is secured to each of said first and second arched rib supports by a plurality of rings attached to a surface of said pre-shaped flexible membrane and a plurality of straps, wherein each of said straps is passed around at least one of said arched chords and is attached to at least one of said rings to form a substantially endless loop around the at least one of said arched chords.

3. The shelter according to claim 2, wherein said preshaped flexible membrane is tensioned around the outer chords of the first and second arched rib supports thereby facilitating the attachment of the straps to the rings.

4. The shelter according to claim 1, wherein said preshaped joiner membrane includes catenary cables adapted so as to tension said pre-shaped joiner membrane proximate at least one of the first and second arched rib supports of each of said collapsible shelters in said interconnecting position.

5. The shelter according to claim 1, wherein said preshaped joiner membrane comprises: (i) a plurality of catenary cables attached proximate edges of said pre-shaped joiner membrane, each catenary cable having a length shorter than an outer perimeter of at least one of the first and second arched rib supports; and (ii) means for connecting each catenary cable to opposing sides of a corresponding one of the collapsible shelters so as to couple said preshaped joiner membrane to said collapsible shelters in a substantially overlapping arrangement.

6. The shelter according to claim 5, including geodetic cables extending over said pre-shaped joiner membrane and having substantially opposing ends coupled to a ground support so as to tension said pre-shaped joiner membrane.

7. The shelter according to claim 5, wherein said preshaped joiner membrane includes four arched leg members extending from a substantially central position and forming four archways.

8. The shelter according to claim 7, including a plurality of geodetic cables extending over said pre-shaped joiner membrane and having substantially opposing ends attached to a ground support so as to tension said pre-shaped joiner membrane.

9. The shelter according to claim 1, wherein said preshaped joiner membrane is adapted to connect said collapsible shelters together in a substantially radially arranged array of interconnected shelter structures.

10. The shelter according to claim 1, wherein said preshaped joiner membrane is adapted to connect said collapsible shelters in a substantially linear array of interconnected shelter structures.

11. A collapsible shelter comprising:

(a) a plurality of arched rib supports hingedly coupled together;

(b) a shelter membrane secured to said arched rib supports and having sufficient area such that when said arched rib supports are arranged in a substantially upwardly position a shelter structure is formed; and (c) a joiner membrane operative to connect said shelter structure to at least one other substantially identical shelter structure, said joiner membrane comprising: (i) a plurality of catenary cables, each catenary cable having a length shorter than an outer perimeter of one of the arched rib supports; and (ii) means for connecting each catenary cable to opposing sides of a corresponding one of the shelter structures;

wherein each catenary cable is adapted to extend over the shelter membrane so as to connect the joiner membrane to the shelter structure in a substantially overlapping arrangement.

12. The shelter according to claim 1, wherein each of said arched rib supports comprises a truss structure having at least three spaced apart substantially parallel chords including an outer chord and an inner chord; and wherein the length of each catenary cable is shorter than a length of the outer chord of one of the arched rib supports.

13. The shelter according to claim 12, wherein each of said shelter structures is saddle-shaped.

14. The shelter according to claim 11, wherein said joiner membrane has a plurality of web belt stress concentrators located proximate the catenary cables and means for connecting said web belt stress concentrators to the shelter structures, each web belt stress concentrator having a pre-set length shorter than the outer perimeter of one of the arched rib supports, wherein said web belt stress concentrators inelastically connect to the opposing sides of the shelter structures.

15. The shelter according to claim 11, wherein said shelter structures are saddle-shaped.

16. The shelter according to claim 11, wherein said joiner membrane includes four arched leg members extending from a substantially central position and forming four archways.

17. The shelter according to claim 11, including a plurality of geodetic cables extending over said joiner membrane and coupled at opposing ends of said joiner membrane to a ground support so as to tension said joiner membrane.

18. The shelter according to claim 11, wherein said joiner membrane is adapted to connect said shelter structures together in a substantially radially arranged array of interconnected shelter structures.

19. The shelter according to claim 11, wherein said joiner membrane is adapted to connect said shelter structures in a substantially linear array of interconnected shelter structures.

20. A shelter joining structure for connecting a collapsible shelter to at least one other collapsible shelter, each collapsible shelter having a plurality of arched rib supports hingedly coupled to a pivot base assembly and a pre-shaped flexible covering secured to the arched rib supports such that when said arched rib supports are arranged in a substantially upwardly position a saddle-shaped structure is formed, the shelter joining structure comprising:

a pre-shaped joiner membrane comprising: (a) a plurality of catenary cables, each catenary cable having a length shorter than an outer perimeter length of one of the arched rib supports; and (b) means for connecting each catenary cable to opposing sides of a corresponding one of the collapsible shelters proximate its pivot base assembly;

wherein said catenary cables are adapted to extend over each pre-shaped flexible covering so as to connect the pre-shaped joiner membrane to the collapsible shelters in a substantially overlapping arrangement.

21. The shelter joining structure according to claim 20, wherein said pre-shaped joiner membrane includes a plurality of web belt stress concentrators and means for connecting said web belt stress concentrators to the saddle-shaped structures, said catenary cables and said web belt stress concentrators located proximate edges of the pre-shaped joiner membrane, each web belt stress concentrator having a pre-set length shorter than the outer perimeter length of one of the arched rib supports, wherein said web belt stress concentrators inelastically connect to the opposing sides of the shelter structures.

22. The shelter joining structure according to claim 21, including geodetic cables extending over said pre-shaped joiner membrane and coupled at opposing ends of said pre-shaped joiner membrane to a ground support.

23. The shelter joining structure according to claim 22, wherein said pre-shaped joiner membrane includes four arched leg members extending from a substantially central position and forming four archways.

24. The shelter joining structure according to claim 21, each arched rib support comprising a truss structure having at least three spaced apart substantially parallel chords including an outer chord and an inner chord; and wherein the length of each catenary cable is shorter than a length of the outer chord of one of the arched rib supports.

25. The shelter joining structure according to claim 20, wherein said pre-shaped joiner membrane is adapted to connect said collapsible shelters together in a substantially radially arranged array of interconnected shelter structures.

26. The collapsible shelter joining structure according to claim 20, wherein said pre-shaped joiner membrane is adapted to connect said collapsible shelters in a substantially linear array of interconnected shelter structures.

* * * * *

UNITED STATES PATENT AND TRADEMARK OFFICE

CERTIFICATE OF CORRECTION

PATENT NO. : 5,899,028
DATED : May 4, 1999
INVENTOR(S) : Gary Werner

It is certified that error appears in the above-identified patent and that said Letters Patent is hereby corrected as shown below:

In column 6, line 66,
replace "according to claim 1"
with - - according to claim 11 - -

Signed and Sealed this
Fourth Day of January, 2000

*Attest:*

*Attesting Officer*

*Acting Commissioner of Patents and Trademarks*